US007410079B2

(12) United States Patent
Kuwahara et al.

(10) Patent No.: US 7,410,079 B2
(45) Date of Patent: Aug. 12, 2008

(54) ACCUMULATOR-TYPE LIQUID SPRAYER

(75) Inventors: Katsuhito Kuwahara, Tokyo (JP); Takayuki Goto, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 496 days.

(21) Appl. No.: 10/513,992

(22) PCT Filed: Sep. 18, 2002

(86) PCT No.: PCT/JP02/09584

§ 371 (c)(1),
(2), (4) Date: Jul. 6, 2005

(87) PCT Pub. No.: WO03/099453

PCT Pub. Date: Dec. 4, 2003

(65) Prior Publication Data

US 2005/0279774 A1 Dec. 22, 2005

(30) Foreign Application Priority Data

May 23, 2002 (JP) ..... 2002-149460

(51) Int. Cl.
*B67D 5/40* (2006.01)

(52) U.S. Cl. ..... 222/321.2; 222/321.7; 222/341

(58) Field of Classification Search ..... 222/321.2, 222/321.7, 341
See application file for complete search history.

(56) References Cited

U.S. PATENT DOCUMENTS 4,607,765 A * 8/1986 Ruscitti ..... 222/321.9
5,377,881 A 1/1995 Jouillat
5,482,188 A * 1/1996 Lina ..... 222/321.2
5,638,996 A 6/1997 Montaner et al.
5,803,318 A * 9/1998 Lina ..... 222/321.2
2002/0003150 A1* 1/2002 Hermouet et al. ..... 222/321.2

FOREIGN PATENT DOCUMENTS

EP 0 691 161 A1 1/1996
GB 2 014 233 A 8/1979

(Continued)

*Primary Examiner*—Kevin P. Shaver
*Assistant Examiner*—Hyea J Choi
(74) *Attorney, Agent, or Firm*—Oliff & Berridge, PLC

(57) ABSTRACT

An accumulator-type liquid sprayer includes a piston arranged in a cylinder, a piston guide extending through a passage extending therethrough in an axial direction of the piston, so as to be engageable with, and disengageable from the piston, cooperating with the piston and the cylinder to form a space region for sucking and pressurizing a liquid, a check valve for opening a suction port of the cylinder during suction of the liquid, and a hollow stem slidably fitted with an outer side of the piston in a liquid-tight manner and engaging with an end portion of the piston guide. A first resilient member urges the piston guide against the piston for maintaining a closed state of the passage in the piston, and a second resilient member urges the piston against the piston guide for adjusting a spraying pressure of the liquid. A stopper is arranged in the cylinder, for positioning the piston before the content is sprayed to provide increased contact surface pressure so as to maintain the closed state of the passage. The piston has an end portion which can be brought into contact with the stopper, and which is formed with an annular recess extending along an outer peripheral edge of the end portion.

9 Claims, 16 Drawing Sheets

FOREIGN PATENT DOCUMENTS

| | | |
|---|---|---|
| JP | A 7-165250 | 6/1995 |
| JP | A 8-26322 | 1/1996 |
| JP | A-09-058732 | 3/1997 |
| JP | A 9-103718 | 4/1997 |
| WO | WO 99/65798 A1 | 12/1999 |

* cited by examiner

ACCUMULATOR-TYPE LIQUID SPRAYER

BACKGROUND ART

1. Technical Field

The present invention relates to an accumulator-type liquid sprayer, and aims to effectively prevent leakage of the liquid within a cylinder of the sprayer.

2. Prior Art

As a sprayer for spraying finely atomized liquid such as lotion, cologne or perfume, aerosol-type sprayers are widely used wherein dispersed fluid is filled in a container together with pressurizing medium. This type of sprayer is relatively expensive in terms of production cost, and requires discharge of the pressurizing medium by piercing a hole in the container when it is discarded, since in many instance the pressurizing medium remains in the container even after the dispersed fluid has been fully consumed. Thus, the disposition of the container is troublesome, besides that discharge of the pressurizing medium into atmosphere may lead to environmental contamination.

Therefore, it is a recent trend to reevaluate accumulator-type liquid sprayer which does not require pressurizing medium as used in the aerosol-type sprayers, and which sprays the content under an elevated inner pressure obtained by a couple of pumping actions of the discharge head. In this connection, reference may be had to a pump-type sprayer as disclosed in U.S. Pat. No. 5,638,996.

Typically, an accumulator-type liquid sprayer includes a cylinder having a suction port communicating with interior of a container and fixedly held at a mouth portion of the container, a piston arranged in the cylinder, a piston guide for opening or closing a passage for passing therethrough a liquid to be sprayed, by engaging with, or disengaging from the piston, a hollow stem for holding one end of the piston guide and having another end in engagement with a back face of the piston through a resilient member, and a pressurizing cap in engagement with the hollow stem and having a nozzle for discharging the content flowing through an internal passage, wherein the pressurizing cap is repeatedly applied with intermittent load for sucking and pressurizing the content and thereby achieving a pumping action for continuously spraying the content.

In this instance, the piston and the piston guide are sandwiched from both sides and thereby held by resilient means (inner pressure adjusting spring and sucking/pressurizing spring). The force of the resilient means is adjusted so that the piston and the piston guide are in contact with each other when the pressurizing cap is not applied with a load, to thereby close the passage for passing the liquid therethrough.

Incidentally, in order to reduce the load to be applied to the pressurizing cap upon spraying the content and thereby realize spraying under a smooth pumping action, it would be effective to lower the resilient force of either one of the inner pressure adjusting spring and sucking/pressurizing spring, among the resilient means. In this instance, however, since the contact pressure between the piston and the piston guide is reduced, liquid leakage may occur in the cylinder, making it difficult to achieve an efficient spraying of the content.

In the case of accumulator-type liquid sprayer, furthermore, since the piston has a substantially flat end surface, if this flat end surface is brought into contact with a stepped surface provided in the cylinder so as to restrict displacement of the piston within the cylinder, the root portion of the stepped surface may cause deformation or damage of the piston end surface, giving rise to degradation of the tightness in the cylinder or admittance of air, making it difficult to achieve sufficient sealing function.

DISCLOSURE OF THE INVENTION

It is an object of the present invention to eliminate the above-mentioned problems and provide a novel accumulator-type liquid sprayer capable of spraying the liquid without leakage of the liquid within the cylinder.

According to a first aspect of the present invention, there is provided an accumulator-type liquid sprayer comprising: a cylinder that can be secured to a mouth portion of a container containing a liquid to be sprayed, said cylinder having a suction port that is communicated with inside of the container; a hollow stem to which a pressurizing cap can be secured, said pressurizing cap being operable by a user for spraying the liquid from said container; a piston secured to the hollow stem and arranged in the cylinder so as to be slidable according to a pushing force from the hollow stem and a resilient force from a resilient means exerted in a direction opposite to said pushing force, said piston defining a space region within the cylinder; a stopper that is brought into contact with an end portion of the piston for restricting displacement of the piston as it is operated; a discharge valve for bringing said space region into communication with the internal passage of the hollow stem by a returning movement of the piston, so that the liquid is discharged from the space region toward outside; and a suction valve for bringing said space region into communication with the suction port of the cylinder by a pushing movement of the piston, so that the liquid is sucked into the space region; wherein the end portion of the piston, which can be brought into contact with said stopper, is formed with an annular recess that extends along an outer peripheral edge of the end portion.

With the above-mentioned constitution, the piston arranged in the cylinder is caused to slidingly move by the pushing force from the hollow stem and the resilient force of the resilient means, so as to increase and decrease the pressure in the space region formed between the piston and the cylinder, to thereby suck and discharge the liquid. In this instance, the displacement amount of the piston in the cylinder is restricted by contact of the end portion of the piston with a stopper, such as a stepped surface provided in the cylinder.

On this occasion, the piston end portion is brought into contact with the stopper at the annular recess formed along the outer peripheral edge of the end portion, without causing contact between the end portion and the root portion of the stopper. Therefore, even when the root portion of the stopper has a shape that otherwise tends to cause damages or deformation of the piston end portion, a positive sealing function can be achieved since the piston end portion is brought into contact with the stopper without contacting its root portion, and it is thus possible to spray the content without leakage of the liquid within the cylinder.

The above-mentioned accumulator-type liquid sprayer may further comprise a cover member for covering an opening of the cylinder with a portion of the hollow stem being exposed, wherein the opening is arranged opposite to the suction port. Here, the cover member is arranged to hold the hollow stem so that the exposed portion of the hollow stem can be pushed and returned, and to integrate each of said members as a module.

In this instance, major mechanisms of the accumulator-type liquid sprayer are integrated as a module, and can thus be secured to containers with various configurations. In other words, in addition to the above-mentioned technical effects obtainer by the accumulator-type liquid sprayer, it is possible to achieve a further technical effect that various changes to the product specification can be immediately accommodated.

According to a second aspect of the present invention, there is provided an accumulator-type liquid sprayer comprising: a cylinder that can be secured to a mouth portion of a container through a base member, said cylinder having a suction port that is communicated with inside of the container; a piston arranged in the cylinder and having a passage extending therethrough in its axial direction; a piston guide extending through the passage in the piston so as to be engageable with, and disengageable from the piston, said piston guide cooperating with the piston and the cylinder to form a space region for sucking and pressurizing a liquid; a check valve for opening the suction port of the cylinder only during suction of the liquid; a hollow stem slidably fitted with an outer side of the piston in a liquid-tight manner and engaging with an end portion of the piston guide; a first resilient member for urging the piston guide against the piston for maintaining a closed state of the passage in the piston; a second resilient member for urging the piston against the piston guide for adjusting a spraying pressure of the liquid; and a stopper arranged in the cylinder, for positioning the piston before the content is sprayed to provide increased contact surface pressure so as to maintain the closed state of the passage.

With the above-mentioned constitution, it is possible to spray the content by a smooth operation with a reduced operating force, without causing leakage of the liquid in the cylinder. The number of components can be reduced, resulting in simplification of the assembly steps and cost reduction. All the components may be formed of a plastic material so as to eliminate requirement for fractional recovery for each material upon disposal of the sprayer.

In the above-mentioned accumulator-type liquid sprayer, the first resilient member may be arranged between the piston guide and a bottom wall portion of the space region. The accumulator-type liquid sprayer may further comprise a pressurizing cap secured to a tip end of the hollow stem and having a nozzle for spraying toward outside a liquid that flows out through an inner space of the hollow stem, wherein the second resilient member is arranged between the hollow stem and the piston. Furthermore, the stopper may be comprised of a ring member that is formed integrally to the base member and brought into a rear end portion of the piston before spraying the liquid.

It is preferred that the above-mentioned accumulator-type liquid sprayer further comprises a stopper that is brought into contact with an end portion of the piston for restricting displacement of the piston as it is operated, wherein the end portion of the piston, which can be brought into contact with said stopper, is formed with an annular recess that extends along an outer peripheral edge of the end portion.

In this instance, the displacement amount of the piston in the cylinder is restricted by contact of the end portion of the piston with the stopper.

On this occasion, the piston end portion is brought into contact with the stopper at the annular recess formed along the outer peripheral edge of the end portion, without causing contact between the end portion and the root portion of the stopper. Therefore, even when the root portion of the stopper has a shape that otherwise tends to cause damages or deformation of the piston end portion, a positive sealing function can be achieved since the piston end portion is brought into contact with the stopper without contacting its root portion, and it is thus possible to spray the content without leakage of the liquid within the cylinder.

The accumulator-type liquid sprayer according to the second aspect of the present invention may further comprise a cover member for covering an opening of the cylinder with a portion of the hollow stem being exposed, wherein the opening is arranged opposite to the suction port. Here, the cover member is arranged to hold the hollow stem so that the exposed portion of the hollow stem can be pushed and returned, and to integrate each of said members as a module.

Specifically, it is preferred that such a module comprises a stopper that is brought into contact with an end portion of the piston for restricting displacement of the piston as it is operated, wherein the end portion of the piston, which can be brought into contact with said stopper, is formed with an annular recess that extends along an outer peripheral edge of the end portion.

With the above-mentioned constitution, major mechanisms of the accumulator-type liquid sprayer are integrated as a module, and can thus be secured to containers with various configurations. In other words, in addition to the above-mentioned technical effects obtainer by the accumulator-type liquid sprayer, it is possible to achieve a further technical effect that various changes to the product specification can be immediately accommodated.

BRIEF DESCRIPTION OF THE DRAWINGS

The present invention will be more fully described below with reference to preferred embodiments shown in the accompanying drawings.

BEST MODE FOR CARRYING OUT THE INVENTION

With reference to the drawings, an accumulator-type liquid sprayer according to the present invention will be described hereinafter.

Figure 1:
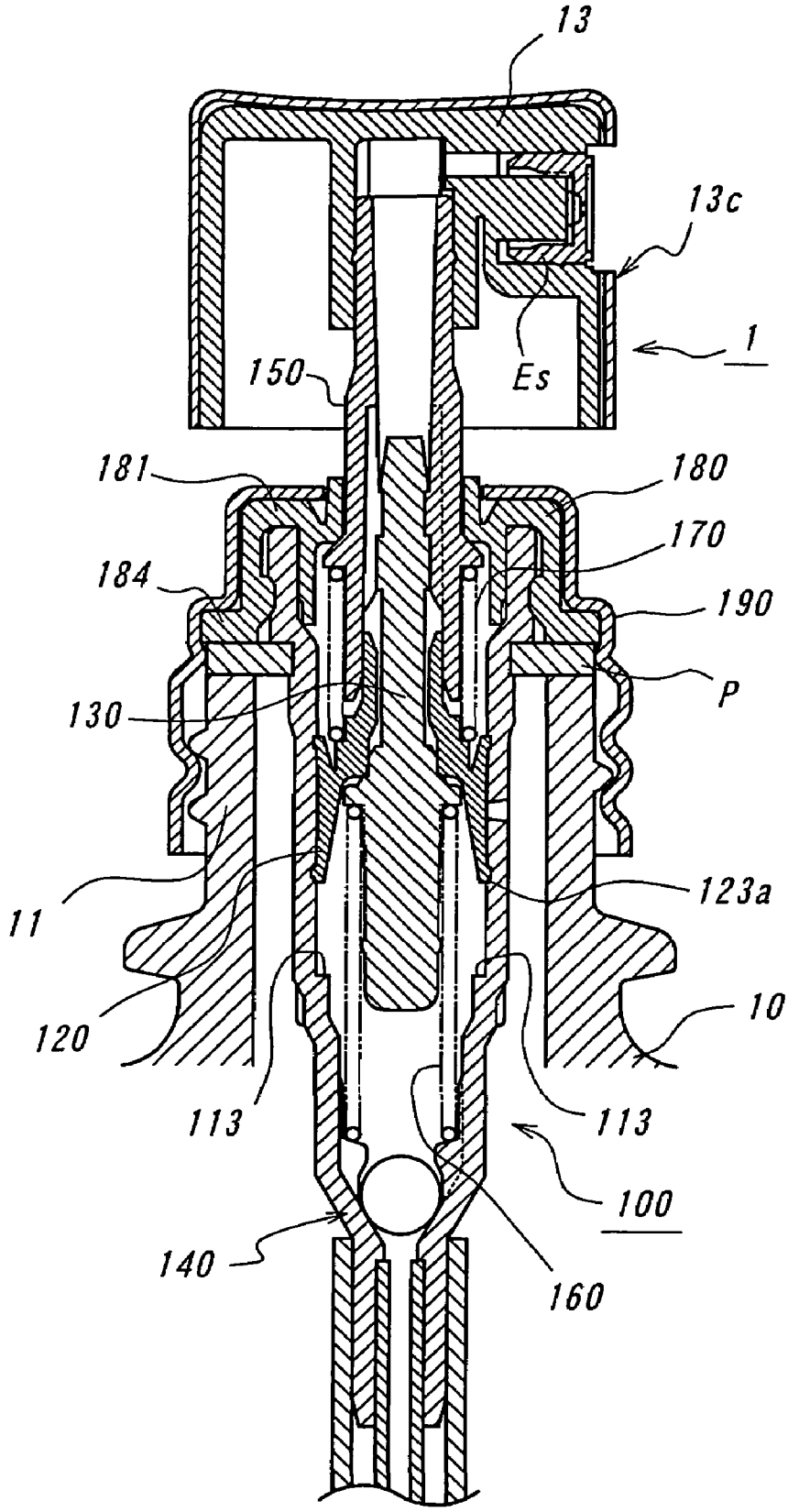
FIG. 1 is a sectional view of an accumulator-type liquid sprayer according to a first embodiment of the present invention.
Figure 2:
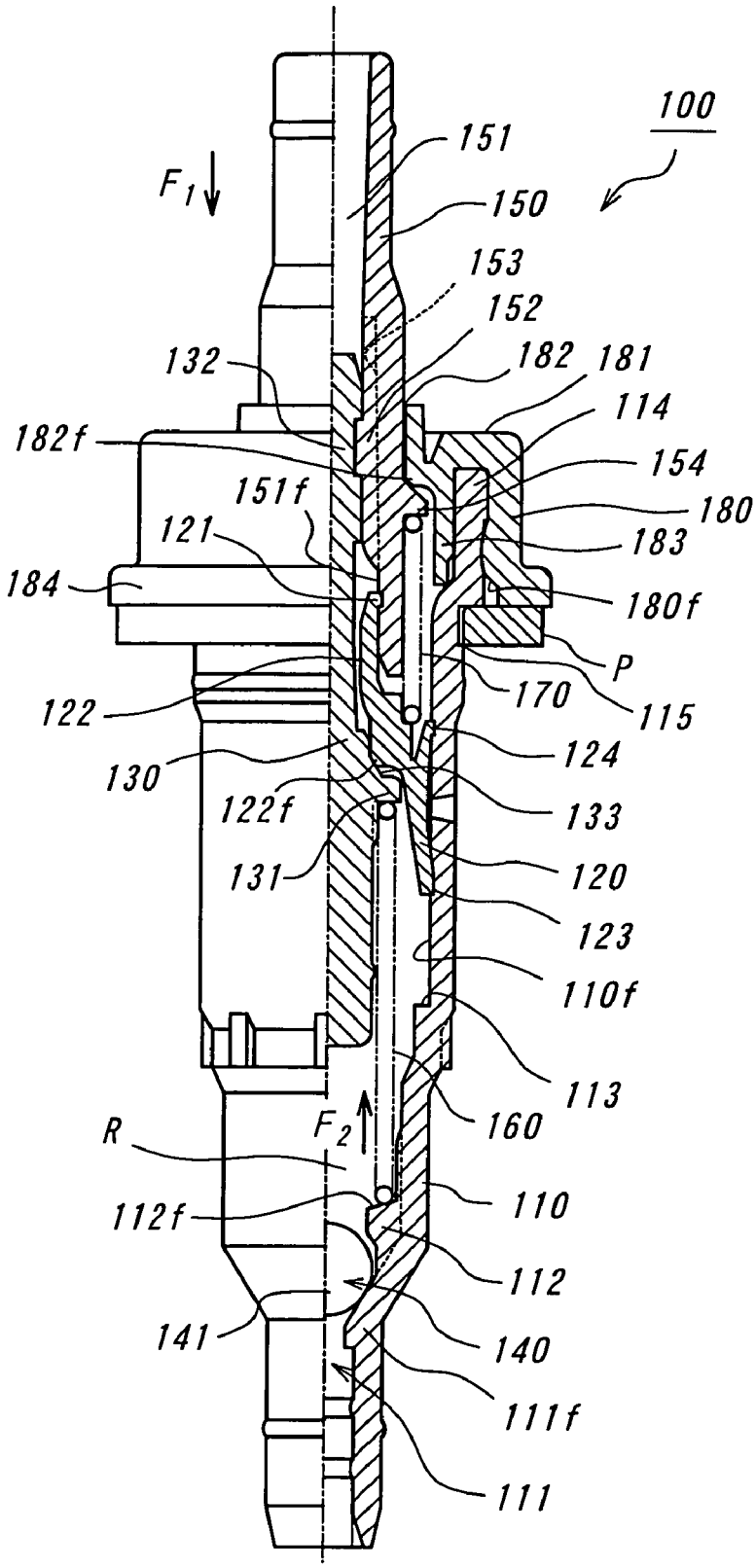
FIG. 2 is a partly sectional side view of a module corresponding to the sprayer shown in FIG. 1.

FIG. 1 is a sectional view of an accumulator-type liquid sprayer according to a first embodiment of the present invention, and FIG. 2 is a partly sectional side view of a module used in the accumulator-type liquid sprayer 1 shown in FIG. 1.

In FIG. 1, reference numeral 10 denotes a container to be filled with a content, reference numeral 11 denotes a mouth portion of the container 10, and reference numeral 100 denotes a module that is shown in FIG. 2.

As shown in FIG. 2, the module is comprised of nine parts, i.e., a cylinder 110. a piston 120, a piston guide 130, a check valve 140, a hollow stem 150, a first resilient member in the form of a spring 160, a second resilient member in the form of a spring 170, a cover member 180 and a seal element P.

The cylinder 110 has a seat portion 111*f* arranged adjacent to a suction port 111 for receiving a ball 141 thereon, and a plurality of ribs 112 for restricting the displacement of the ball 141. The spring 160 is arranged on the upper surfaces 112*f* of these ribs 112 to hold one end 131 of the piston guide 130. The other end 132 of the piston guide 130 is integrally secured to a plurality of ribs 152 formed at internal passage 151 of the hollow stem 150. These ribs 152 are spaced apart so as to form an annular internal passage 153 that is communicated with the internal passage 151.

The piston 120 cooperates with the cylinder 110 to define a space region (pump chamber R) therebetween. The piston 120 is slidably held, through its base portion 121, by a part 151*f* of the internal passage 151 formed in the hollow stem 150. The piston 120 has an internal passage 122 through which the piston guide 130 extends. The internal passage 122 has a part 122*f* that is brought into sliding contact with an outer peripheral portion 133 of the piston guide 130 by the spring 170 arranged between the piston 120 and a flange 154 of the hollow stem 150. By this, the piston 120 is permitted to slide along the inner wall surface 110*f* of the cylinder 110 through its front end portion 123 and rear end portion 124, with a pushing motion induced by a pushing force F1 from the hollow stem 150, and a return motion induced by a resilient force F2 that is applied by the spring 160 via the piston guide 130.

Therefore, when the hollow stem is pushed forward to pressurize the pump chamber R, the piston 120 and the piston guide 130 are separated from each other to communicate the pump chamber R with atmosphere via the internal passages 122, 153 and 151. On the other hand, when the piston 120 is pushed back to depressurize the pump chamber R, the ball 141 is separated from the seat portion 111*f* adjacent to the suction port 111 against its own weight, to open the pump chamber R.

In this way, the piston 120 and the piston guide 130 form a discharge valve that is opened by the pushing motion of the piston 120 induced by the pushing operation of the hollow stem 150 to discharge the liquid within the pump chamber R toward atmosphere, while the seat portion 111*f*, the ribs 112 and the ball 142 form a suction valve that is opened by the pushing-back motion of the piston induced by the resilient force of the spring 160 to suck the liquid into the pump chamber.

The seal element P is fitted in the groove portion 115 that is undercut along the outer periphery of the cylinder 110. The cover member 180 in its upper portion has a through hole 182 through which the hollow stem extends, and is provided with an inner wall 183 for fitting the opening portion 114 of the cylinder 110 in cooperation with the inner surface 180*f*. Thus, at a position where the cover member 180 is in contact with the seal element P, the cover member 180 seals the opening portion 114 of the cylinder 110 and restricts the movement of the hollow stem 150 applied with the resilient force of the spring 170 by causing the flange portion 154 of the hollow stem 150 to contact with the inner wall 182*f* of the through hole 182. In this way, the cover member 180 covers the opening portion 114 of the cylinder 110 with the hollow stem 150 partly exposed, and holds the hollow stem 150 allowing the latter to be pushed and returned.

The accumulator-type liquid sprayer 1 shown in FIG. 1 is of a so-called spray-type using the above-mentioned module 100, wherein the hollow stem 150 exposed from the cover member 180 is provided with a pressurizing cap 13 containing a nozzle tip Es. The liquid sprayer 1 is secured to the mouth portion 11 of the container 10 through a base member 190 in the form of a metal screw cap. The pressurizing cap 13 has an ornamental cap cover 13*c*.

The cover member 180 has an outer peripheral portion that is integrally provided with a flange portion 184. Thus, as shown in FIG. 1, by laying the metal screw cap 190 over the upper portion 181 and the flange portion 184 of the cover member 180 and subsequently causing shrinkage thereof, it is possible to achieve a screw connection of the accumulator-type liquid sprayer 1 to the mouth portion 11 of the container 10. In this instance, it is possible to achieve a cost reduction since adhesive or connector elements for the connection with the cover member 180 is not required.

The operation of the accumulator-type liquid sprayer 1 in conjunction with the module 100 will be explained below.

When the pressurizing cap 13 is manually depressed down, the hollow stem 150 is initially pushed in the direction indicated by arrow F1 as shown in FIG. 2. In cooperation with the pushing operation of the hollows stem 150, the piston 120 is pushed within the cylinder 110 against the resilient force of the spring 160 to pressurize the inside of the pump chamber R.

Then, since the pressure within the pump chamber P is increased, the piston 120 and the piston guide 130 are separated from each other against the resilient force of the spring 160, leaving the ball 141 seated on the seat portion 111*f*, so as to discharge the liquid within the pump chamber R toward outside from the nozzle Es of the pressurizing cap 13, via the internal passage 122 of the piston and the internal passages 153 and 151 of the hollow stem. Subsequently, the piston 120 and the piston guide 130 are brought into a sealing contact by the resilient force of the spring 160. When the user's hand is thereafter released from the pressurizing cap 13 to interrupt the pushing operation with respect to the hollow stem 150, the piston 120 is pushed back through the piston guide 130 by the resilient force of the spring 160 to generate a negative pressure within the pump chamber R. Thus, the ball 141 is separated from the seat portion 111*f* against its own weight, maintaining a sealing contact between the piston 120 and the piston guide 130, so as to suck the liquid from outside and introduce it into the pump chamber R.

Subsequently, by repeating the pushing operation of the hollow stem 150 through the pressurizing cap 13, the pressure of the liquid filling the pump chamber R is increased and decreased so that the discharge valve comprised of the piston 120 and the piston guide 130 and the suction valve 140 comprised of the ball 141 are alternately operated to suck the liquid from outside and discharge the liquid from the nozzle Es of the pressurizing cap 13 through the internal passage 151 in the hollow stem 150.

In the accumulator-type liquid sprayer 1 and the module 100 thereof, the pushing motion of the piston 120 is restricted as the front end portion 123 of the piston 120 is brought into contact with the stepped surface 113 formed in the cylinder 110.

Figure 3A:
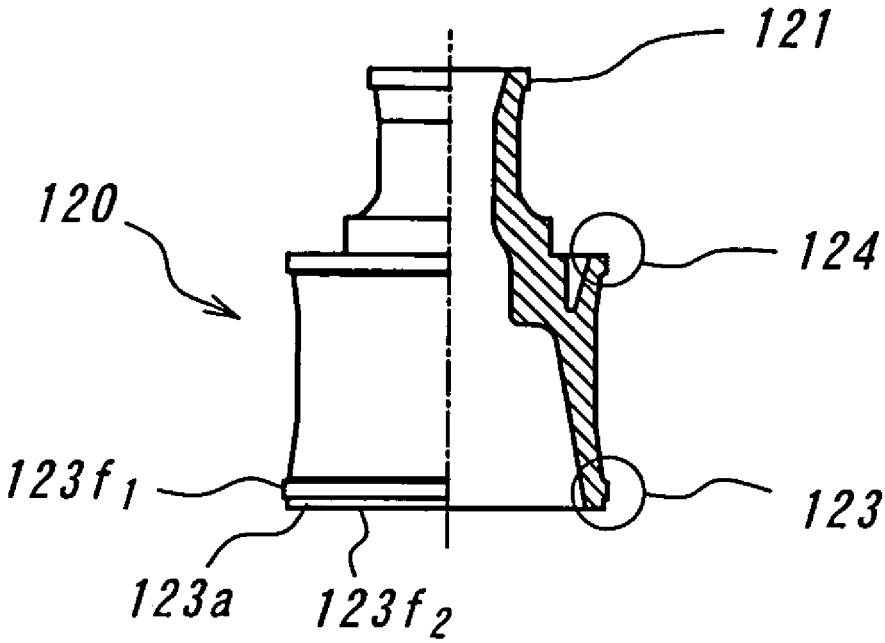
FIGS. 3A and 3B are, respectively, a partly sectional side view of the piston shown in FIGS. 1 and 2, and a sectional view of the piston end portion in enlarged scale.
Figure 3B:
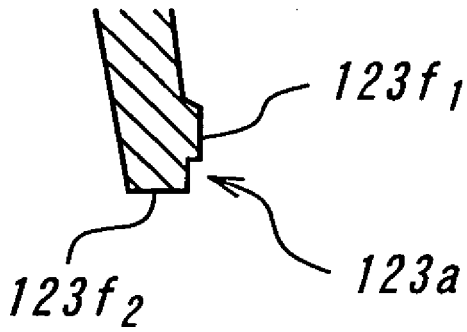
Figure 4:
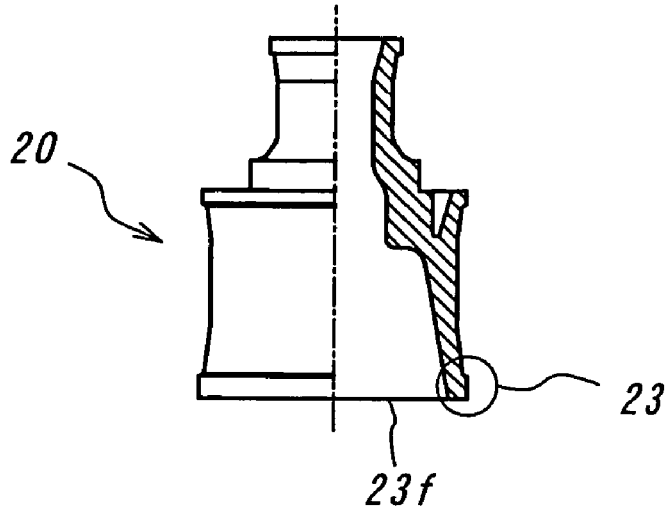
FIG. 4 is a partly sectional side view of a conventional piston.
Figure 5A:
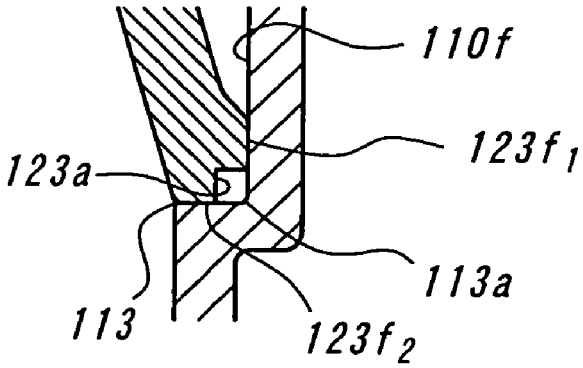
FIGS. 5A and 5B are sectional views showing a state in which the end portion of the piston shown in FIGS. 1 to 3 is brought into contact with a stepped surface provided in the cylinder, as well as a state in which the end portion of the conventional piston shown in FIG. 4 is brought into contact with a stepped surface provided in the cylinder, respectively.
Figure 5B:
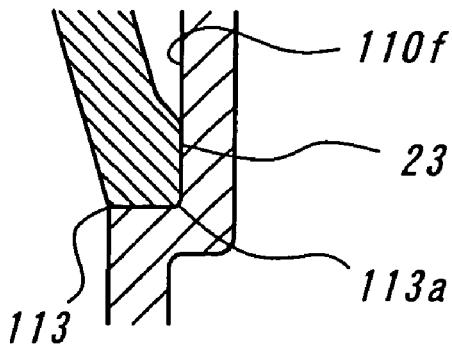

FIGS. 3A and 3B are, respectively, a partly sectional side view of the piston 120 and a sectional view of the piston end portion 123 in enlarged scale. FIG. 4 is a partly sectional side view of a conventional piston 20. FIGS. 5A and 5B are sectional views showing a state in which the end portion 123 of the piston 120 is brought into contact with a stepped surface 113 formed in the cylinder 110, as well as a state in which the end portion 23 of the conventional piston 20 is brought into contact with a stepped surface 113 formed in the cylinder 113, respectively.

As shown in FIGS. 3A and 3B, the piston 120 has a front end portion 123 on its lower side, which is formed with an annular stepped recess 123*a* that divides the end portion 123 into a sliding surface 123*f*1 slidably engageable with the inner wall surface 110*f* of the cylinder and a contact surface 123*f*2 that can be brought into contact with the stepped surface 113.

With the module 100 and the accumulator-type liquid sprayer 1 using the same, the piston 120 arranged in the cylinder 110 is caused to slidingly move by the pushing force F1 from the hollow stem 150 and the resilient force F2 of the spring 160, so as to increase and decrease the pressure in the pump chamber R between the piston 120 and the cylinder 110, to thereby suck and discharge the liquid. In this instance, the displacement amount of the piston 120 in the cylinder 110 is restricted by contact of the end portion 123 of the piston 120 with the stepped surface 113 provided in the cylinder 110.

On this occasion, as shown in FIG. 5A, the front end portion 123 of the piston 120 is brought into contact with the stepped surface 113*f* at the annular recess 123*a* formed along the outer peripheral edge of the end portion, without causing contact between the end portion and the root portion 113*a* of the stepped surface 113.

In contrast, in the case of the conventional piston 20, its end portion 23 has a substantially flat contact surface 23*f* and is thus brought into contact with the root portion 113*a* of the stepped surface 113, as shown in FIG. 5B, thereby causing deformation or damage of the piston end surface and giving rise to degradation of the sealing function, depending upon the shape of the root portion 113*a*.

Therefore, with the module 100 and the accumulator-type liquid sprayer 1 using the same, even when the root portion 113*a* of the stepped surface 113 has a shape that otherwise tends to cause damages or deformation of the front end portion 123 of the piston 120, a positive sealing function can be achieved since the front end portion 123 of the piston 120 is brought into contact with the stepped surface 113 without contacting its root portion 113*a*, and it is thus possible to spray the content without leakage of the liquid within the cylinder.

The module 100 is to modularize the major mechanisms of the accumulator-type liquid sprayer 1 into an integrated assembly so that it can be secured to elements having various configurations. Therefore, in addition to the technical effects obtainer by the accumulator-type liquid sprayer 1, the module 100 makes it possible to achieve a further technical effect that various changes to the product specification can be immediately accommodated. Incidentally, the annular recess 123*a* is not limited in shape to the above-mentioned stepped recess, but also may be a recess wherein the sliding surface 123*f*1 and the contact surface 123*f*2 forming the lower end portion are connected to each other by a straight line or a curved line.

Figure 6:
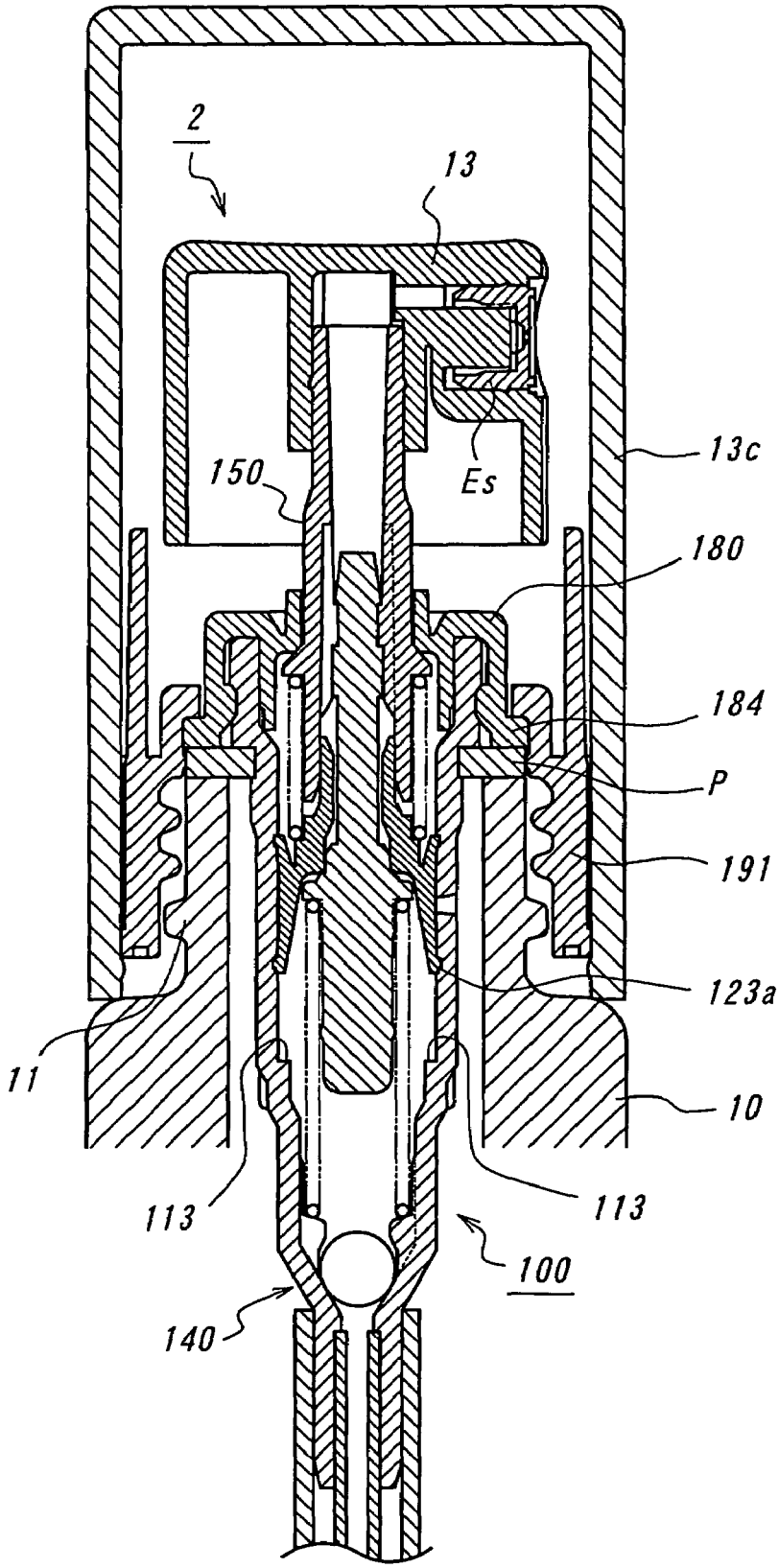
FIG. 6 is a sectional view of an accumulator-type liquid sprayer according to a second embodiment of the present invention, which uses the module shown in FIG. 1.

FIG. 6 is a sectional view of the accumulator-type liquid sprayer according to a second embodiment of the present invention, which also uses the module 100. Elements shown in FIGS. 1 to 5 are denoted by the same reference numerals and explanation thereof is omitted.

The accumulator-type liquid sprayer 2 shown in FIG. 6 is of spray-type similar to that shown in FIG. 1, which is secured to the mouth portion 11 of the container 10 through a base member 191, though the head cover 13*c* is detachably secured to the base member 191.

In the case of the accumulator-type liquid sprayer 2 also, the cover member 180 has an outer peripheral portion integrally provided with a flange portion 184. Therefore, it can be secured to the moth portion 11 of the container 10 simply by undercut fitting the base member 191 with the flange portion 184 of the cover member 180, and it is thus possible to achieve a cost reduction since adhesive or connector elements for the connection with the cover member 180 is not required.

Incidentally, the accumulator-type liquid sprayer according to the above-mentioned first aspect of the present invention may be directly secured to the mouth portion 11 of the container 10 without using the module 100 such as that shown in FIG. 2.

Figure 7:
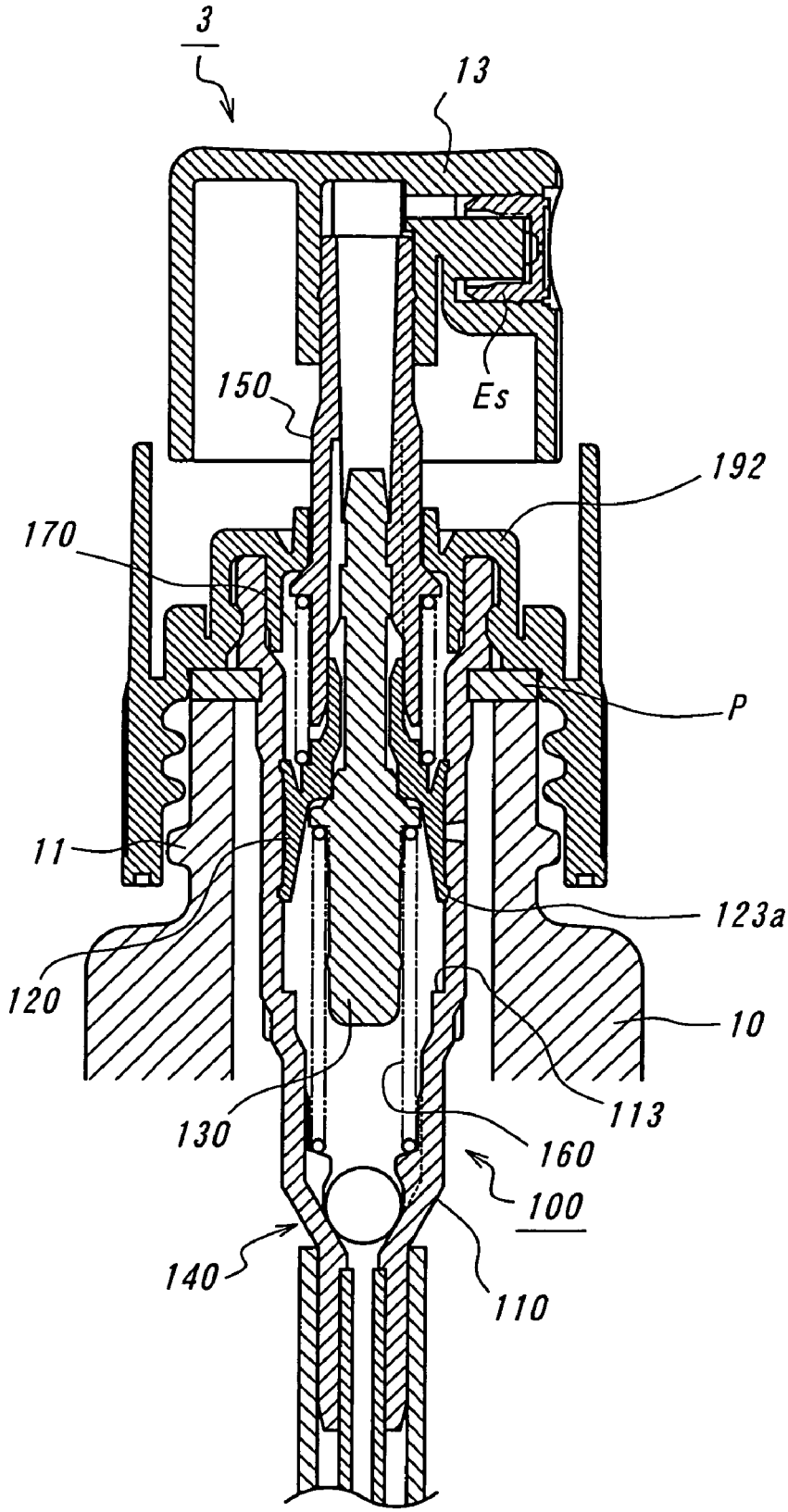
FIG. 7 is a sectional view of an accumulator-type liquid sprayer according to a third embodiment of the present invention.

FIG. 7 is a sectional view of the accumulator-type liquid sprayer according to a third embodiment of the present invention. Elements shown in FIGS. 1 to 6 are denoted by the same reference numerals and explanation thereof is omitted.

The accumulator-type liquid sprayer 3 shown in FIG. 7 is of the type wherein the cylinder 110 is secured to the mouth portion 11 of the container 10 through a base member 192. In this instance also, since the front end portion 123 of the piston 120 is formed with an annular recess 123*a* along the outer peripheral edge of the end portion, even when the root portion 113*a* of the stepped surface 113 has a shape that otherwise tends to cause damages or deformation of the front end portion 123 of the piston 120, a positive sealing function can be achieved since the front end portion 123 of the piston 120 is brought into contact with the stepped surface 113 without contacting its root portion 113*a*, and it is thus possible to spray the content without leakage of the liquid within the cylinder.

Incidentally, in the accumulator-type liquid sprayer 1 to 3 and the module 100 thereof, only the front end portion 123 of the piston 120 is provided with an annular recess 123*a* in order to restrict the displacement amount of the piston 120 by a contact of the front end portion 123 of the piston 120 with the stepped surface 113 when the piston 120 is pushed. However, when a stopper is provided, which is brought into contact with the rear end portion 124 of the piston 120 for limiting its displacement amount, the rear end portion 124 of the piston 120 may be provided with an annular recess along its outer peripheral edge.

Now, in the accumulator-type liquid sprayer 1 to 3 and the module 100 as shown in FIGS. 1 to 7, it would be effective to lower the resilient force of either one of the springs 160, 170, so as to reduce the load to be applied to the pressurizing cap 13 or the hollow stem 130 upon spraying the content and thereby realize spraying under a smooth pumping action. In this instance, however, since the contact pressure between the piston 120 and the piston guide 130 is reduced, liquid leakage may occur in the cylinder 110, making it difficult to achieve an efficient spraying of the content.

Therefore, with reference to the drawings, there will be described below a novel accumulator-type liquid sprayer that allows a smooth spraying of the liquid under a low load without causing liquid leakage within the cylinder.

Figure 8:
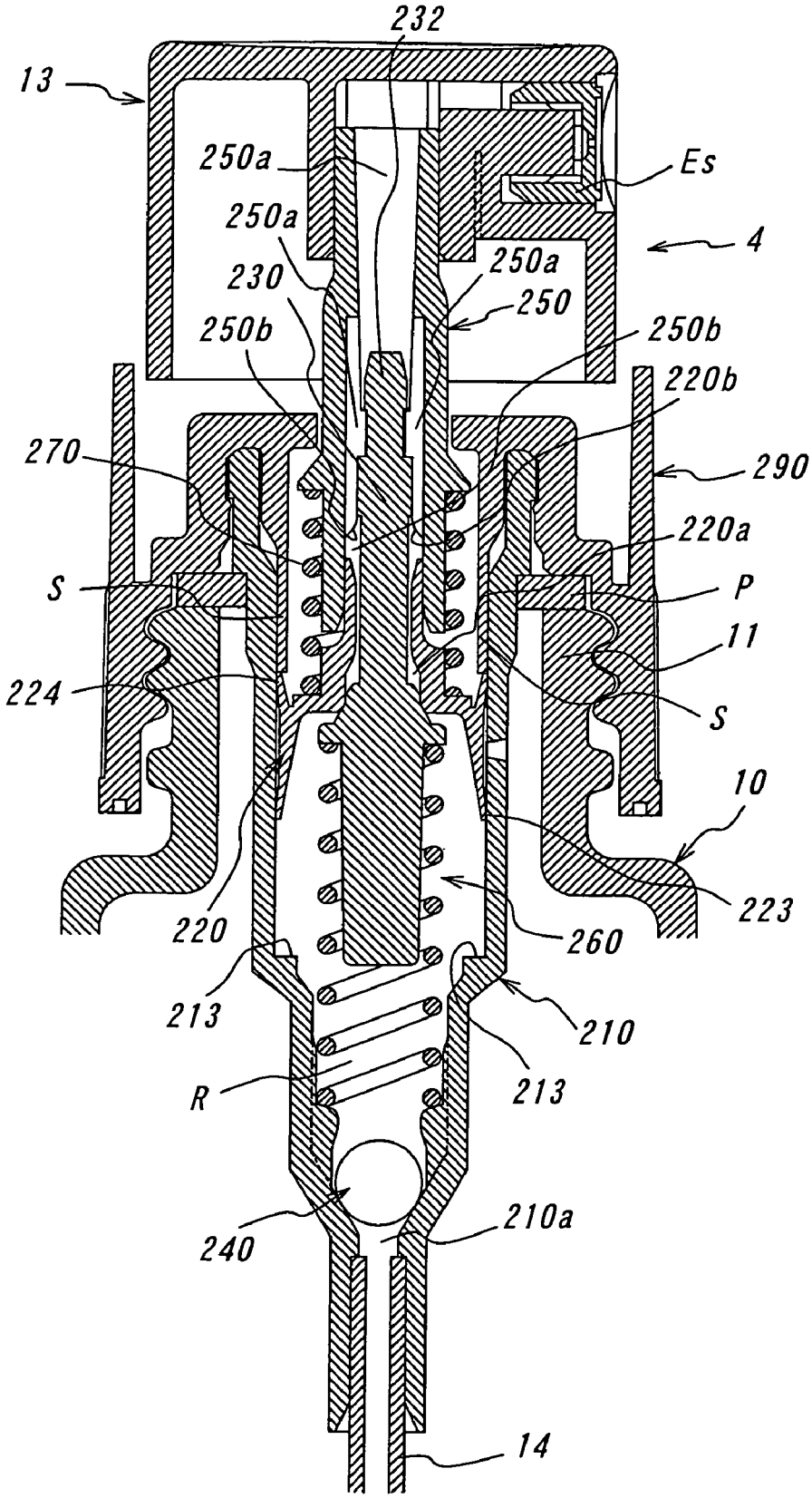
FIG. 8 is a sectional view of an accumulator-type liquid sprayer according to a fourth embodiment of the present invention.

FIG. 8 is a sectional view of the accumulator-type liquid sprayer according to a fourth embodiment of the present invention. In the accumulator-type liquid sprayer 4 shown in FIG. 8, reference numeral 10 denotes a container to be filled with content, and reference numeral 11 denotes a mouth portion of the container 10.

Reference numeral 210 denotes a cylinder that is secured to the mouth portion 11 of the container 10 through a base member 290. The cylinder 210 has a bottom wall portion that is formed with a suction port 210*a* for sucking the content through a suction tube 14. The base member 290 is exemplarily shown as having an opening that is in communication with inside of the container 10, and as being threadedly secured to the mouth portion.

Reference numeral 220 denotes a piston that is arranged in the cylinder 210. The piston 220 has an internal passage 220*a* extending therethrough in its axial direction.

Reference numeral 230 denotes a piston guide. This piston guide 230 is arranged to extend through the internal passage 220*a* of the piston 220 and serves to open or close the internal passage 220*a*, and cooperates with the cylinder 210 and the piston 220 to define a space region (pump chamber) R for sucking and pressurizing the liquid.

Reference numeral 240 denotes a check valve that opens the suction port 210*a* only when the liquid is sucked, and reference numeral 250 denotes a hollow stem. The hollow stem 250 is slidably fitted over the outer side of the piston 220 in a liquid-tight manner and engaged with the end portion 232 of the piston guide 230.

Reference numeral 13 denotes a pressurizing cap that is secured to the tip end of the hollow stem 250. The pressurizing cap 13 includes a nozzle Es for discharging fluid, such as air or liquid, to outside through the internal passage 250*a* of the hollow stem 250.

Reference numeral 260 denotes a first resilient member. The first resilient member 260 is arranged in the pump chamber R within the cylinder 220, and serves to urge the piston guide 230 against the piston 220 to thereby maintain a closed state of the passage 220*a* of the piston 220.

Reference numeral 270 denotes a second resilient member. This resilient member 270 is exemplarily shown as being arranged between the piston 220 and the hollow stem 250, and serves to urge the piston 220 against the piston guide 230 to thereby adjust the spraying pressure (internal pressure) of the content.

Reference character S denotes a stopper that is exemplarily shown as being integrally formed with the base member 290 as its inner ring. The stopper S is brought into contact with the rear end portion 224 of the piston 220 to thereby position the piston 220 before spraying the content. Incidentally, the pushing motion of the piston 220 is restricted when the front end portion 223 of the piston 220 is brought into contact with the stepped surface 213, since the stepped surface 213 provided in the cylinder 210 functions as a stopper.

The passage 220*a* in the piston 220 is maintained in a closed state by urging the piston 220 and the piston guide 230 in opposite directions by means of the first and second resilient members 260 and 270. When, however, the resilient force of the second resilient member 270 is decreased to allow a smooth spraying of the content, the urging force of the piston 220 relative to the piston guide 230 is decreased to degrade the sealing property of the passage 220*a* in the closed state, thereby giving rise to an internal leakage.

According to the present embodiment, the stopper S is brought into contact with the rear end portion 242 of the piston for positioning the same, so that the urging force of the first resilient member 260 applied to the piston 220 is maintained constant even when the resilient force of the second resilient member 270 is changed. It is thus possible to ensure a smooth spraying of the content without degrading the sealing property in the closed state of the passage 220*a*.

While the stopper S has been exemplarily shown as being integrally formed with the base member 290, it may be formed as a separate member or, alternatively, molded integrally with the cylinder 210 like the stepped surface 213, if not particularly problematic from the viewpoint of production technology.

The first resilient member 260 and the second resilient member 270 may be comprised of helical coil springs, though the shape is not particularly limited provided that a desired resilient force can be assured. These resilient members may be comprised of plastics, though they may be alternatively comprised of metal if not hazardous in terms of the quality of the content.

Figure 9:
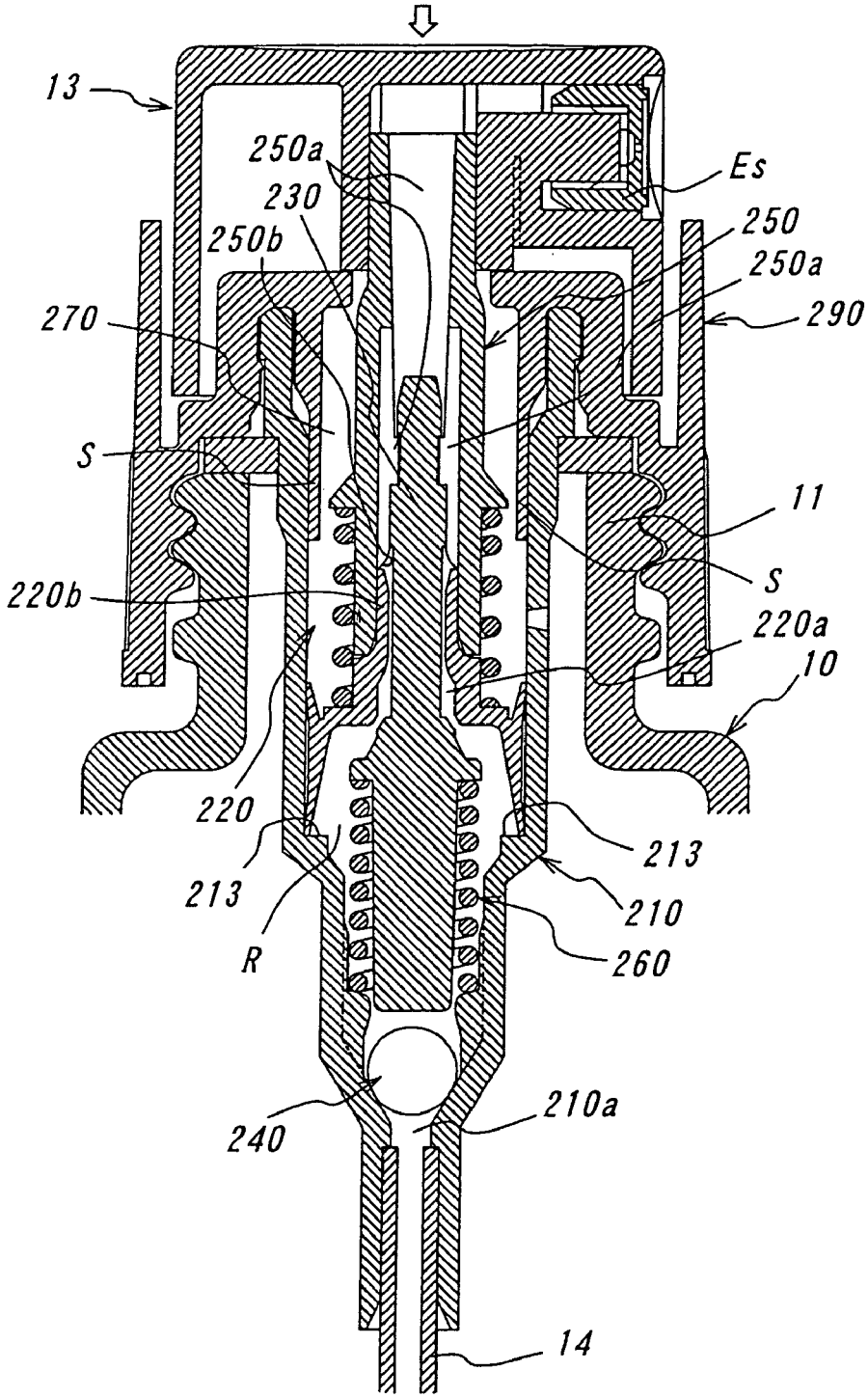
FIG. 9 is a sectional view showing the sprayer of FIG. 8 in a pushed state.

As shown in FIG. 9, when a load is applied to the upper surface of the pressurizing cap 13 to push down the piston 220 together with the hollow stem 250, and the load is thereafter removed, the hollow stem and the piston 220 are returned to the initial positions under the restoring force of the first resilient member 260. On this occasion, the space region R is depressurized so that the content within the container 10 is introduced into the space region R through the suction tube 14 and the suction port 210*a*.

Figure 10:
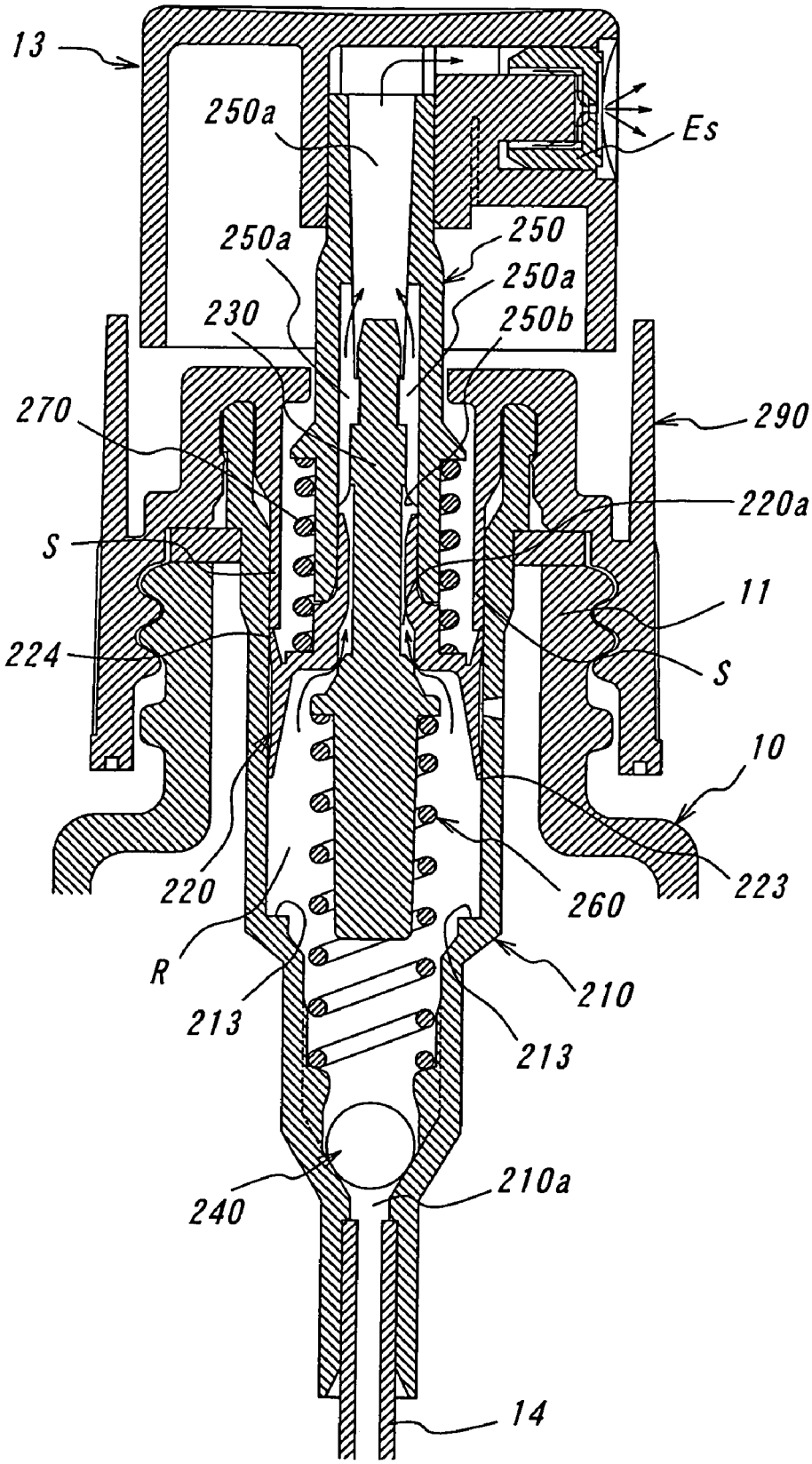
FIG. 10 is an explanatory view explaining the manner of spraying in the sprayer of FIG. 8.

In this condition, when the upper surface of the pressurizing cap 13 is applied with a load to push down the piston 220 together with the hollow stem 250, as shown in FIG. 10, the suction port 210*a* is closed by the check valve 240 so that the pressure in the space region R increases. On the other hand, in terms of the relation between the piston 220 and the hollow stem 250, the passage 220*a* is opened until the inner end 250*b* of the hollow stem 250 comes into abutment with the end surface 220*b* of the piston 220, so that the content under the increased inner pressure is passed through the internal space 250*a* of the hollow stem 250 and sprayed to outside from the nozzle Es of the pressurizing cap 13.

By repeated application of the load to the pressurizing cap 13, therefore, the content is continuously sprayed and a pressurizing medium indispensable in the aerosol-type sprayer is not required.

Figure 11:
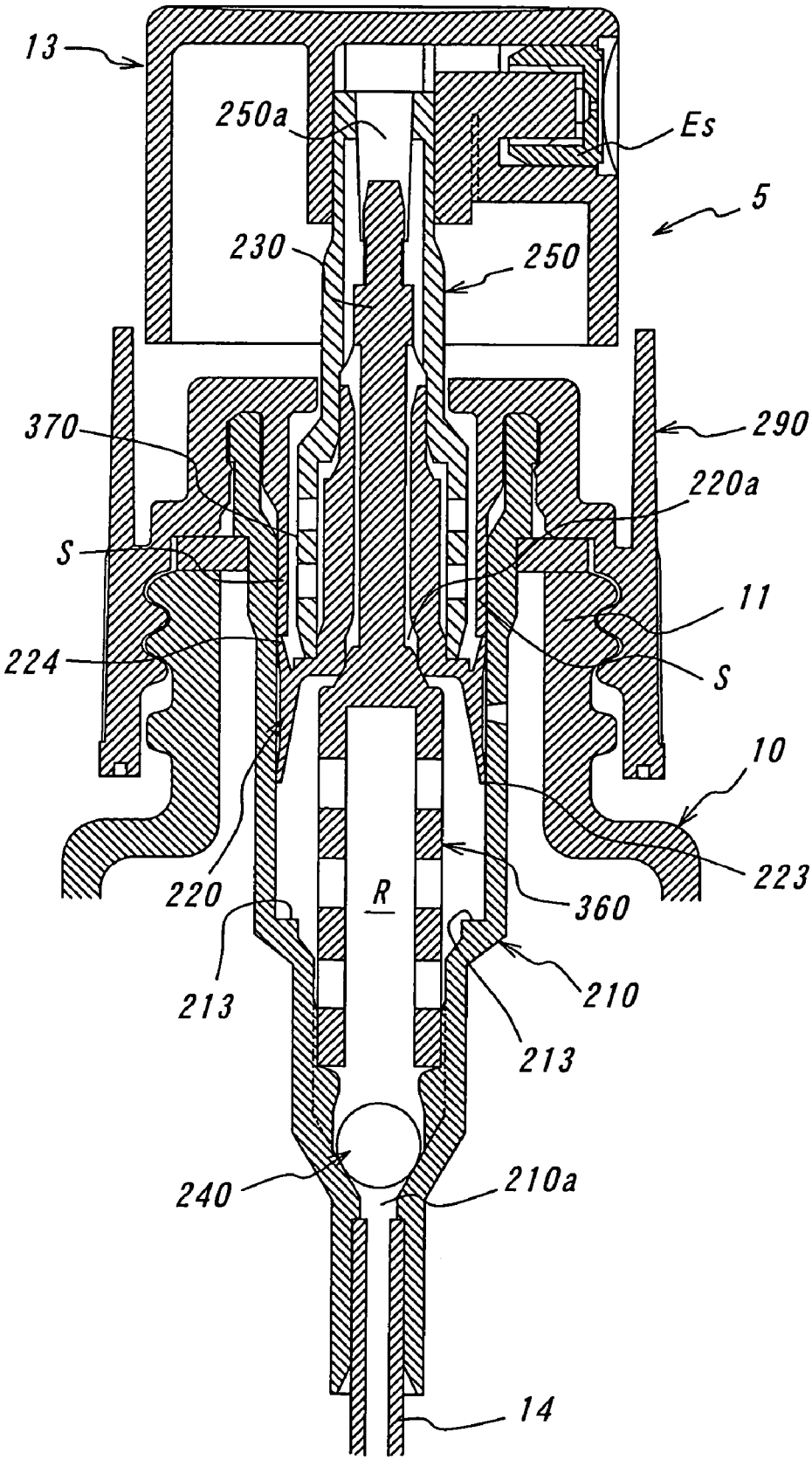
FIG. 11 is a sectional view of an accumulator-type liquid sprayer according to a fifth embodiment of the present invention.

In the embodiment shown in FIG. 8, each element may be comprised of plastics. In particular, as shown in FIG. 11, when the first and second resilient members are formed as unitary members that are integrally formed with the piston guide 230 and the hollow stem 250, respectively, it is possible advantageously to reduce the number of components.

Figure 12:
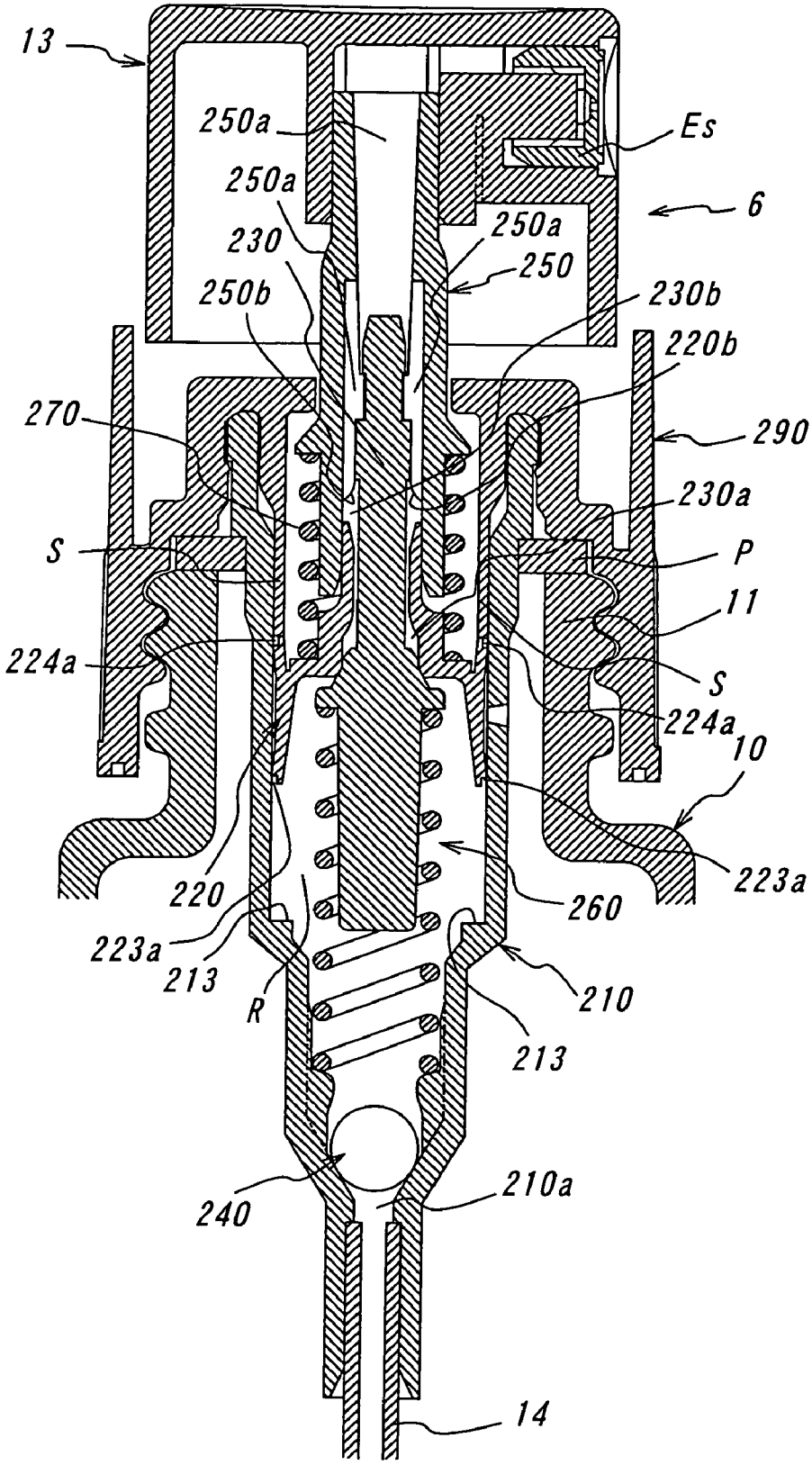
FIG. 12 is a sectional view of an accumulator-type liquid sprayer according to a sixth embodiment of the present invention.

FIG. 12 is a sectional view of the accumulator-type liquid sprayer according to a sixth embodiment of the present invention. This accumulator-type liquid sprayer 6 is a modification of the embodiments shown in FIGS. 8 to 10, and comprises a piston 220 having front and rear end portions 223 and 224, which are respectively formed with annular recesses 223*a*, 224*a* extending along the outer peripheral edges.

In this instance, the displacement amount of the piston 220 within the cylinder 210 is restricted by contact of the front end portion 223 of the piston 220 with the stepped surface 213 provided in the cylinder 210, and further by a contact of the rear end portion 224 of the piston 220 with the stopper S formed integrally with the base member 290.

On this occasion, the front end portion 223 and the rear end portion 224 of the piston 220 are brought into contact with the stepped surface 213 and the stopper S, respectively, without contacting the root portions of the stepped surface 213 and the stopper S. Thus, even when the root portions of the stepped surface 213 or the stopper S has a shape that otherwise tends to cause damages or deformation of the front end portion 223 or the rear end portion 224 of the piston 120, a positive sealing function can be achieved since the front end portion 223 or the rear end portion 224 of the piston 220 is brought into contact with the stepped surface 213 or the stopper S without contacting the root portion of the stepped surface 213 or the stopper S, and it is thus possible to spray the content without leakage of the liquid within the cylinder.

Figure 13:
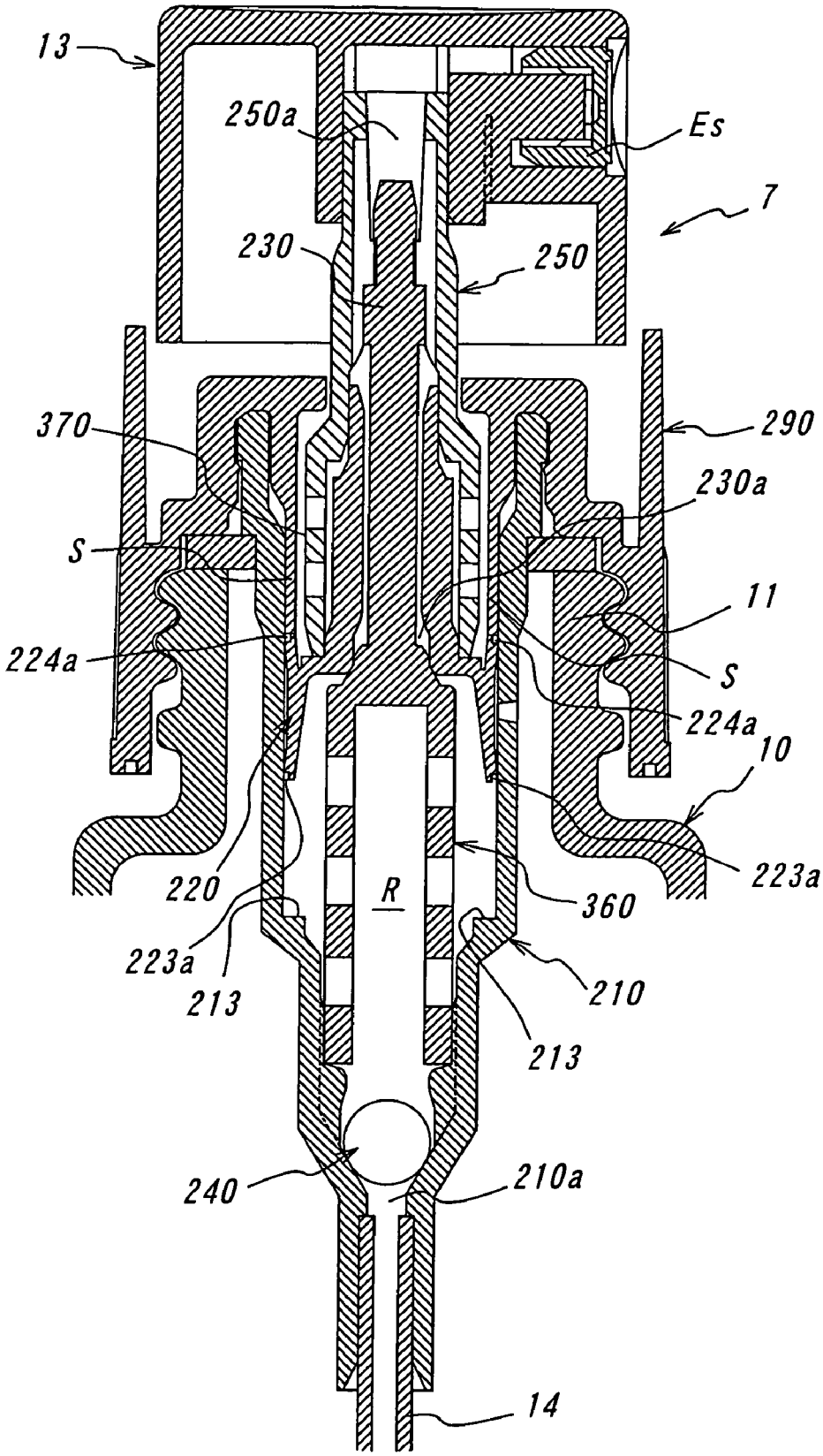
FIG. 13 is a sectional view of an accumulator-type liquid sprayer according to a seventh embodiment of the present invention.
Figure 14:
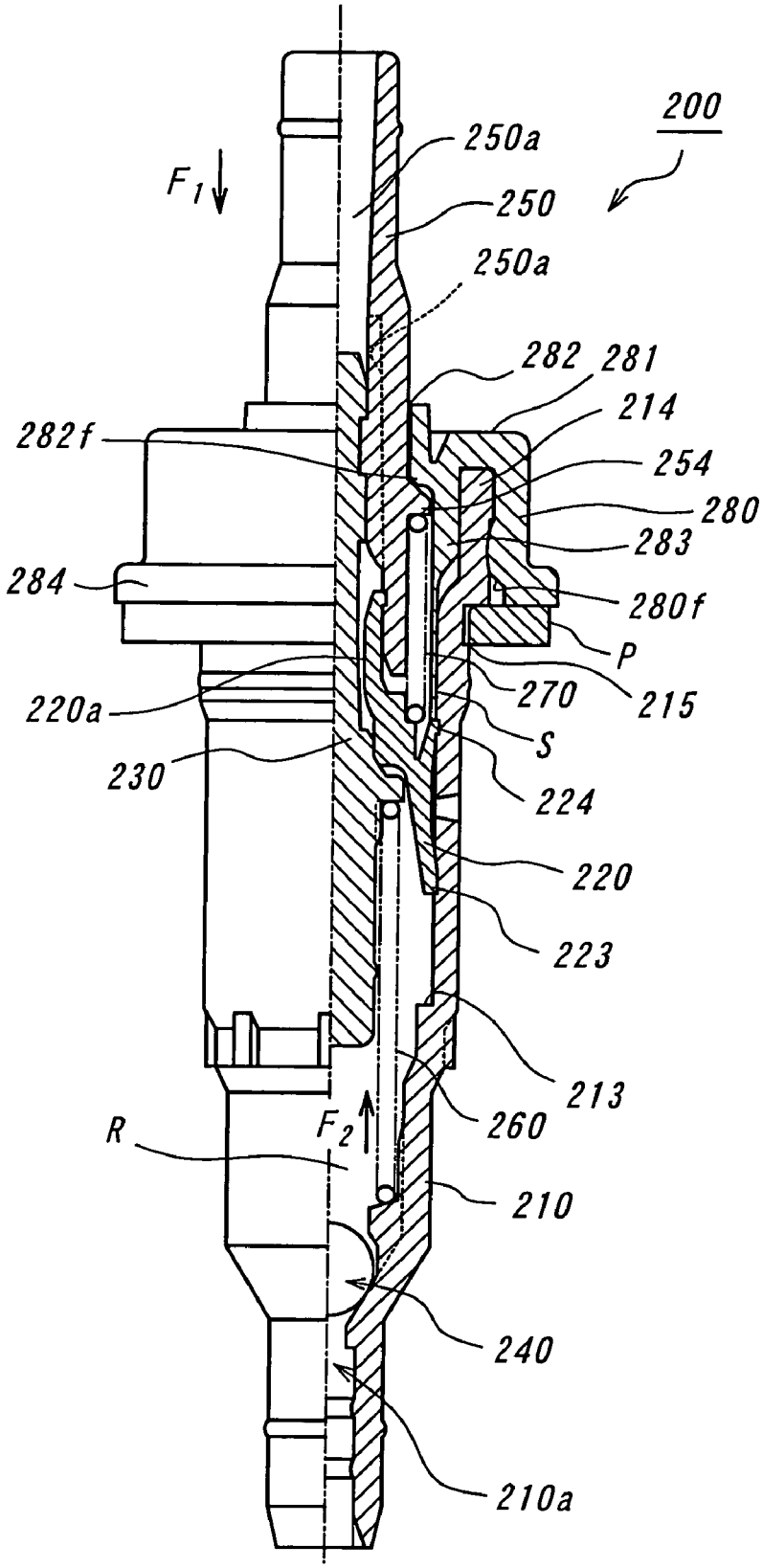
FIG. 14 is a sectional view of a module corresponding to the sprayer of FIG. 8.
Figure 15:
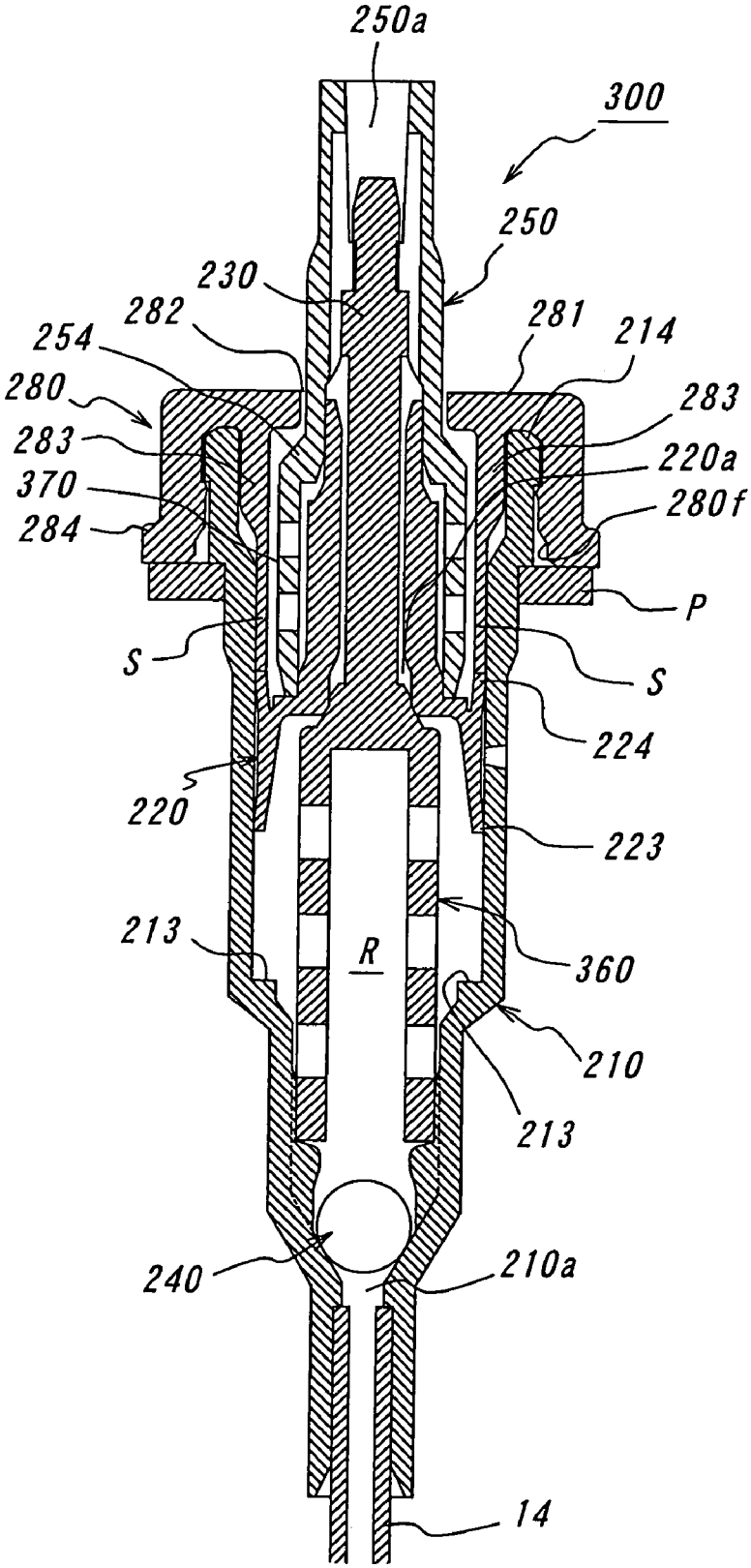
FIG. 15 is a sectional view of a module corresponding to the sprayer of FIG. 11.
Figure 16:
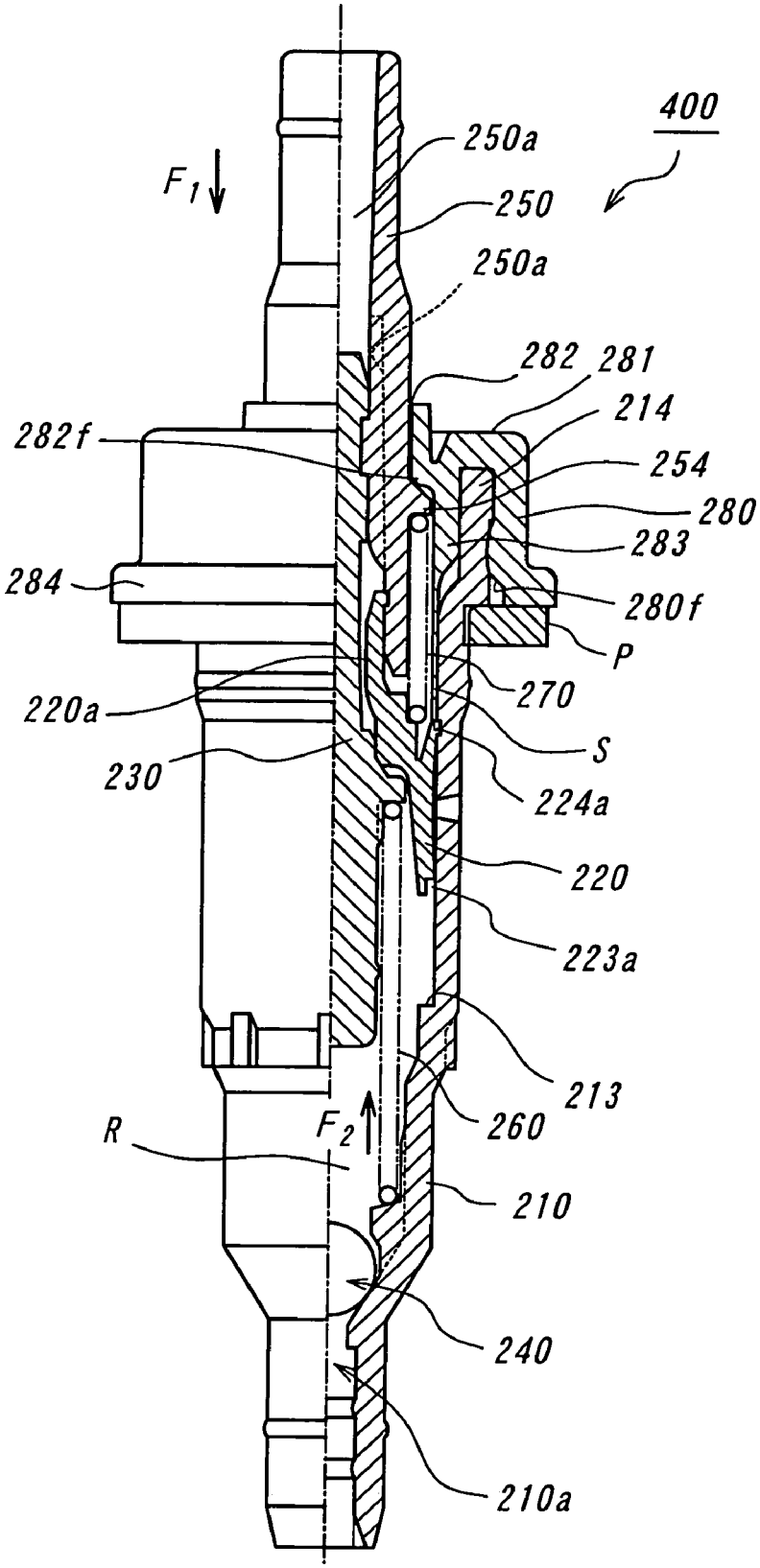
FIG. 16 is a sectional view of a module corresponding to the sprayer of FIG. 12.
Figure 17:
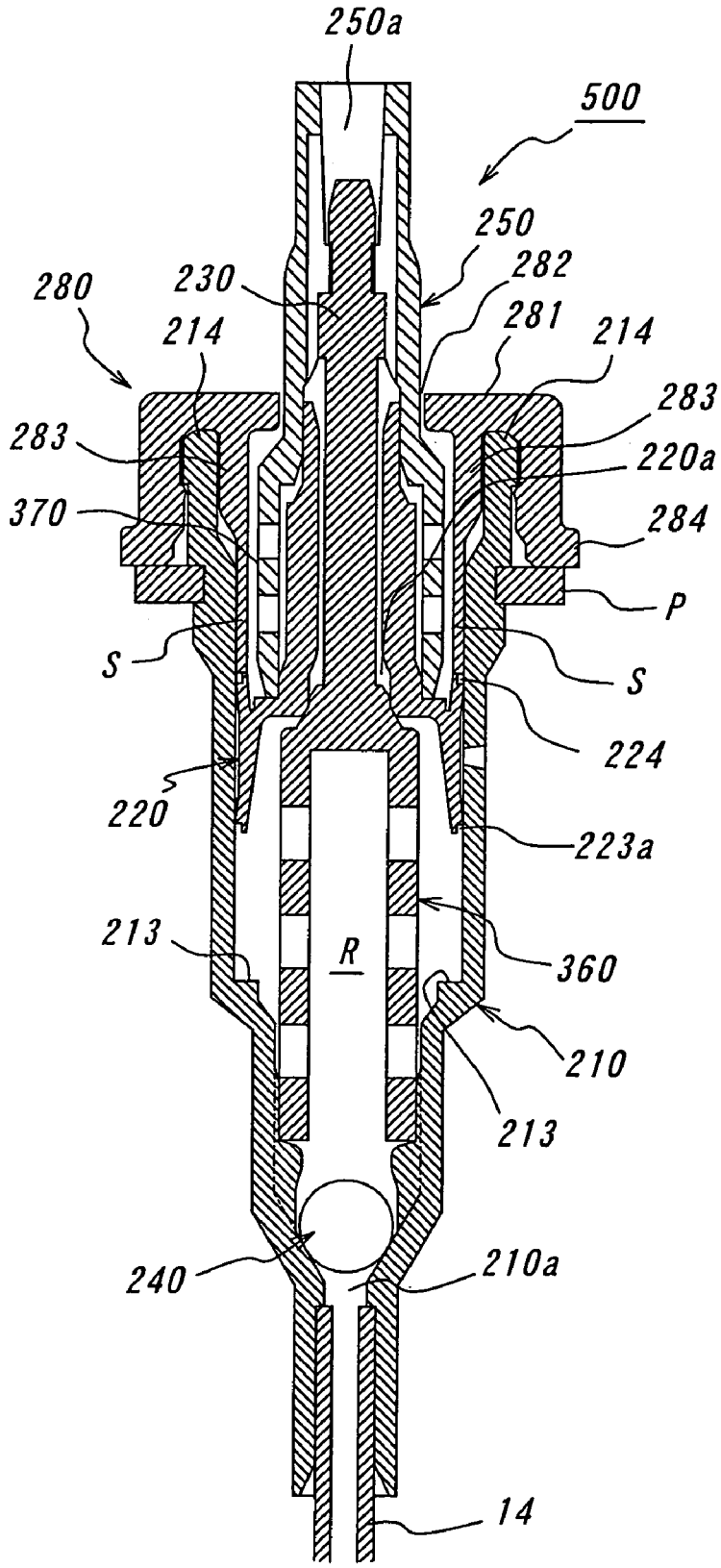
FIG. 17 is a sectional view of a module corresponding to the sprayer of FIG. 13.

FIG. 13 is a sectional view of the accumulator-type liquid sprayer according to a seventh embodiment of the present invention. This accumulator-type liquid sprayer 7 combines the fifth and sixth embodiments of FIGS. 11 and 12, and comprises a piston 220 having front and rear end portions 223 and 224, which are respectively formed with annular recesses 223*a*, 224*a* extending along the outer peripheral edges. This embodiment is essentially the same as the sixth embodiment except the structure of the first and second resilient members.

Incidentally, the accumulator-type liquid sprayers 4 to 7 according to the present invention may be formed as modules 200 to 500 shown in FIGS. 14 to 17, wherein all elements are integrated as an assembly.

As shown in FIGS. 14 to 17, the modules 200 to 500 each comprises a seal element P that is fitted in an undercut groove 215 formed in the outer periphery of the cylinder 210. The cover member 280 in its upper portion has a through hole 282 through which the hollow stem extends, and is provided with an inner wall 283 for fitting the opening portion 214 of the cylinder 210 in cooperation with the inner surface 280*f*.

Thus, at a position where the cover member 280 is in contact with the seal element P, the cover member 280 seals the opening portion 214 of the cylinder 210 and restricts the movement of the hollow stem 250 applied with the resilient force of the spring 270 by causing the flange portion 254 of the hollow stem 250 to contact with the inner wall 282*f* of the through hole 282. In this way, the cover member 280 covers the opening portion 214 of the cylinder 210 with the hollow stem 250 partly exposed, and holds the hollow stem 250 allowing the latter to be pushed and returned.

In the embodiments shown in FIGS. 14 to 17 also, the cover member 180 has an outer peripheral portion integrally provided with a flange portion 184. Therefore, it can be secured to the moth portion 11 of the container 10 by using a base member 190, 191 as shown in FIG. 1 or FIG. 6.

In the modules shown in FIGS. 14 to 17 also, a stepped surface 213 is provided in the cylinder 210 and the inner wall 283 is provided with a stopper S that is integral with the cover member 280 as an inner ring. Therefore, as in the accumulator-type liquid sprayers 6 and 7 and the modules 400 and 500 thereof, it is preferred that the annular recesses 223*a*, 224*a* provided for the piston 220 are formed in the front end portion 223 and the rear end portion 224 of the piston 220, respectively, though such annular recess may be provided for only one of the front end portion 223 and the rear end portion 224 of the piston 220.

The present invention has been described above with reference to the preferred embodiments and it is apparent to a skilled person that various modifications may be made without departing from the scope of the invention. For example, instead of a spray-type using a nozzle tip, the accumulator-type liquid sprayer may be of a type in which highly viscous fluid, such as emulsion, is directly discharged. Also, the accumulator-type liquid sprayer may be of a type in which a cleansing cream is discharged onto a cotton or puff by depressing a tray-like nozzle head provided for the piston.

The components of the sprayer can be each produced by injection molding or the like, though the present invention is not limited to a particular production method.

In this connection, there may be used polyethylene, polypropylene, nylon, ABS resin or the like, besides polyethylene terephthalate (PET), polybuthylene terephthalate (PBT) or polyoxymethylene (POM) which are excellent in chemical resistance.

The invention claimed is:

1. An accumulator-type liquid sprayer comprising:

a cylinder that can be secured to a mouth portion of a container containing a liquid to be sprayed, the cylinder having a suction port that is communicated with inside of the container;

a hollow stem to which a pressurizing cap can be secured, the pressurizing cap being operable by a user for spraying the liquid from the container;

a piston secured to the hollow stem and arranged in the cylinder so as to be slidable according to a pushing force from the hollow stem and a resilient force from a resilient means exerted in a direction opposite to the pushing force, the piston defining a space region within the cylinder;

a stopper that is brought into contact with an end portion of the piston for restricting displacement of the piston as it is operated;

a discharge valve for bringing the space region into communication with the internal passage of the hollow stem by a pushing movement of the piston, so that the liquid is discharged from the space region toward outside; and a suction valve for bringing the space region into communication with the suction port of the cylinder by a returning movement of the piston, so that the liquid is sucked into the space region, wherein the end portion of the piston is formed with an annular recess that extends along an outer peripheral edge of the end portion, and wherein the annular recess divides the end portion of the piston into a sliding surface slidably engageable with an inner wall surface of the cylinder and a contact surface that can be brought into contact with the stopper.

2. The accumulator-type liquid sprayer according to claim 1, further comprising a cover member for covering an opening of the cylinder with a portion of the hollow stem being exposed, the opening being arranged opposite to the suction port, the cover member holding the hollow stem so that the exposed portion of the hollow stem can be pushed and returned, and the cover member integrating each the members as a module.

3. An accumulator-type liquid sprayer comprising:

a cylinder that can be secured to a mouth portion of a container through a base member, the cylinder having a suction port that is communicated with inside of the container;

a piston arranged in the cylinder and having a passage extending therethrough in its axial direction;

a piston guide extending through the passage in the piston so as to be engageable with, and disengageable from the piston, the piston guide cooperating with the piston and the cylinder to form a space region for sucking and pressurizing a liquid;

a check valve for opening the suction port of the cylinder only during suction of the liquid;

a hollow stem slidably fitted with an outer side of the piston in a liquid-tight manner and engaging with an end portion of the piston guide;

a first resilient member for urging the piston guide against the piston for maintaining a closed state of the passage in the piston;

a second resilient member for urging the piston against the piston guide for adjusting a spraying pressure of the liquid; and a stopper arranged in the cylinder, for positioning the piston before the content is sprayed to provide increased contact surface pressure so as to maintain the closed state of the passage, wherein an end portion of the piston, is formed with an annular recess that extends along an outer peripheral edge of the end portion, and wherein the annular recess divides the end portion of the piston into a sliding surface slidably engageable with an inner wall surface of the cylinder and a contact surface that can be brought into contact with the stopper.

4. The accumulator-type liquid sprayer according to claim 3, wherein the first resilient member is arranged between the piston guide and a bottom wall portion of the space region.

5. The accumulator-type liquid sprayer according to claim 3, further comprising a pressurizing cap secured to a tip end of the hollow stem and having a nozzle for spraying toward outside a liquid that flows out through an inner space of the hollow stem, and wherein the second resilient member is arranged between the hollow stem and the piston.

6. The accumulator-type liquid sprayer according to claim 3, wherein the stopper is comprised of a ring member that is formed integrally to the base member and brought into a rear end portion of the piston before spraying the liquid.

7. The accumulator-type liquid sprayer according to claim 3, wherein the stopper is brought into contact with the end portion of the piston for restricting displacement of the piston as it is operated.

8. The accumulator-type liquid sprayer according to claim 3, further comprising a cover member for covering an opening of the cylinder with a portion of the hollow stem being exposed, the opening being arranged opposite to the suction port, the cover member holding the hollow stem so that the exposed portion of the hollow stem can be pushed and returned, and the cover member integrating each the members as a module.

9. The accumulator-type liquid sprayer according to claim 8, wherein the stopper that is brought into contact with the end portion of the piston for restricting displacement of the piston as it is operated.

* * * * *